United States Patent [19]

Prats et al.

[11] 4,282,750

[45] Aug. 11, 1981

[54] PROCESS FOR MEASURING THE FORMATION WATER PRESSURE WITHIN AN OIL LAYER IN A DIPPING RESERVOIR

[75] Inventors: Michael Prats; Alexander S. Williamson, both of Houston, Tex.

[73] Assignee: Shell Oil Company, Houston, Tex.

[21] Appl. No.: 137,342

[22] Filed: Apr. 4, 1980

[51] Int. Cl.[3] ..... E21B 49/00

[52] U.S. Cl. ..... 73/155

[58] Field of Search ..... 73/73, 155, 151, 74; 166/250

[56] References Cited

U.S. PATENT DOCUMENTS

| | | | |
|---|---|---|---|
| 3,702,564 | 11/1972 | Chenevert | 73/73 |
| 3,934,468 | 1/1976 | Brieger | 73/155 |

*Primary Examiner*—Jerry W. Myracle

[57] ABSTRACT

A pressure substantially equalling the formation water pressure within an oil-productive portion of a subterranean reservoir can be directly measured by displacing a limited portion of water into a continuous water phase extending through a material having an oil entry pressure high enough to effectively prevent oil entry while maintaining a permeability to water, and fluid communication with the reservoir, allowing imbibition to reduce the pressure within the water phase, and subsequently measuring that pressure.

7 Claims, 6 Drawing Figures

REPEAT FORMATION
TESTER

PROCESS FOR MEASURING THE FORMATION WATER PRESSURE WITHIN AN OIL LAYER IN A DIPPING RESERVOIR

BACKGROUND OF THE INVENTION

This invention relates to a process for measuring a quantity useful in determining the amount of oil that may be contained within an oil layer or oil column of a dipping reservoir in which there is water or gas at a location not encountered by a borehole. More particularly, the invention relates to a process for directly measuring the formation water pressure at a selected depth within the portion of such an oil column which is encountered by a borehole.

It is known that within such an oil-productive portion of such a reservoir the distance between measuring location and the oil-water interface is proportional to the difference between the oil pressure and the formation water pressure at the measuring location. But, as far as applicants are aware, no method for directly measuring such a water pressure has been previously proposed. Where determinations were previously made of the distance between a point within a borehole and an oil-water interface not encountered by the borehole, the determinations were based on a formation water pressure measured within a water layer encountered in a nearby reservoir. Such determinations were often inaccurate because of the differences in the geological situations.

SUMMARY OF THE INVENTION

This invention relates to a well logging process for measuring the formation water pressure in an oil-productive portion of a dipping reservoir which contains a water layer at a location different from the measuring location. A logging tool is positioned within the well at a selected depth at which the oil-containing portion of the reservoir is encountered. Water is mechanically displaced within the logging tool so that the displaced water becomes a continuous water phase or column which (a) has a relatively small volume (b) extends through permeable material having pores too small to pass a significant amount of particles of water-based mud cake and a capability of functioning as a selectively water-permeable capillary diaphragm and (c) extends into an adjacent oil-productive portion of the reservoir. The displacement of the water is then stopped. The pressure within the water column is allowed to decrease due to the imbibition of water into the oil-containing reservoir. When the rate of that decrease becomes relatively small, as the pressure within the water column asymptotically approaches the formation water pressure within the reservoir, the formation water pressure is measured by measuring the pressure within the water column.

A related alternative to the above procedure, which may be more convenient in some cases, is to measure the water pressure in a cap rock or shale layer immediately adjacent to the reservoir. Because of the extremely low permeability of the cap rock a simple formation test to measure the water pressure is not feasible. However, by establishing a continuous water column, using a small volume of injected water as described above, the water pressure within the shale can be determined. Since the water-phase within such an adjoining low permeability formation is contiguous with the water-phase within the oil reservoir, the formation water pressure in the adjoining portion of the oil reservoir is thus determined. The measurement must be taken at a location sufficiently close to the oil reservoir for possible differences in geological processes to have negligible influence. Such locations should be within 20 feet, or preferably 10 feet, from the oil reservoir. In such measurements the use of a selectively water-permeable capillary diaphragm or mud-particle screen within the logging device may not be required since the cap rock or shale may serve as a combination of the two. of the two.

DESCRIPTION OF THE INVENTION

It is known that the various fluids, such as oil, water and gas, which are apt to be present in a subterranean reservoir are generally concentrated in descending layers of increasing density. The distribution is influenced by factors such as the relative buoyancy of each fluid and the nature, porosity, permeability, grain size, etc., of the reservoir rock. However, at least a film of interstitial or intergranular water is usually present and continuous throughout the reservoir. As indicated by text books such as "The Dynamics of Fluids in Porous Media" by J. Baer, published by American Elsevier Publishing Company, Inc., pages 477–478, it is known that within a permeable earth formation the distance between the depth of a measuring location and the depth of an oil-water interface is proportional to the oil and water pressures at the measuring location divided by the difference between the oil and water densities. But, where a well encounters only an oil column within a dipping reservoir that contains water at a location different from the measuring location, the pressure and density of the oil is all that can be measured or accurately determined by means of the previously known formation sampling and testing tools and techniques. The density of the interstitial water may be estimated from that of nearby formations if no water can be recovered from the reservoir of interest.

The present invention is, at least in part, premised on the discovery that it is feasible to use a conventionally used type of formation sampling and testing tool, or a modification of such a tool, so that it can provide a direct measurement which substantially equals the formation water pressure at a selected depth within such an oil column. The so-determined pressure can be used, as described below, to determine the location of an oil/water interface and/or can be used, by a similar procedure, to determine the location of a gas/oil interface.

Figure 1:
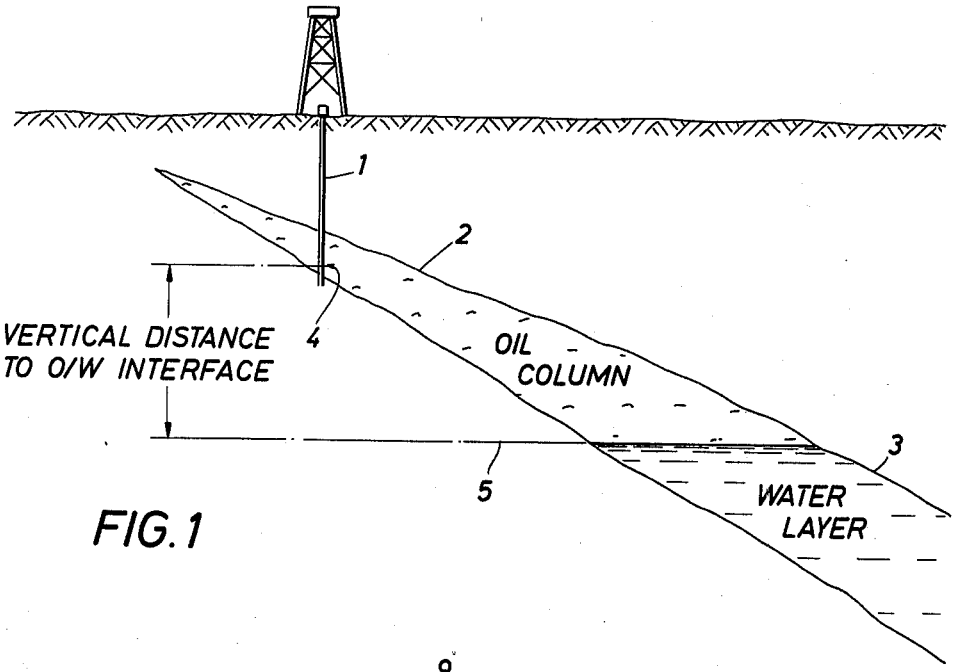
FIG. 1 is a schematic representation of an oil-productive portion or column of a dipping reservoir to which the present invention is applicable.

FIG. 1 shows well 1 drilled through an oil column 2 of a reservoir containing a remotely-located water layer 3. The present invention provides a means for making direct measurements substantially equalling the formation water pressure within the oil column at the depth of the measuring location 4, so that a determination can be made of the distance between the depth of the measuring location and that of the oil-water interface 5.

Figure 2:
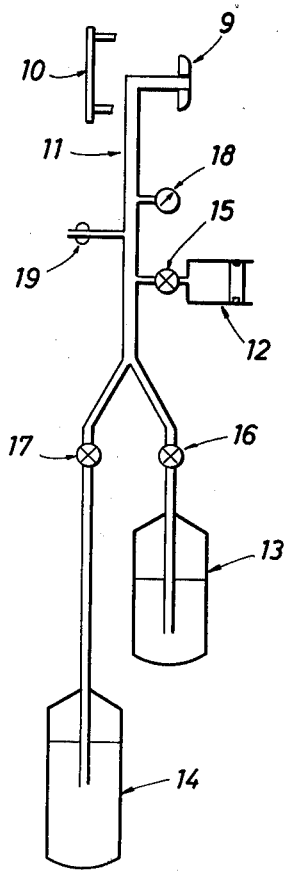
FIG. 2 (PRIOR ART)
FIG. 2 is a schematic illustration of a known type of logging tool which can be modified for use in practicing the present invention.

FIG. 2 is a schematic illustration of a "Repeat Formation Tester" sampling system described in SPE Paper No. 5035, presented at the 49th Annual Fall Meeting, Oct. 6–9, 1974. Such a tool contains a packer 9 for forming a seal around a portion of a reservoir encountered by the borehole and a backshoe 10 for being pressed against the opposite side of the borehole to push the packer against the reservoir. A flowline 11 is arranged for conducting fluid between the packer and a series of chambers, 12, 13 and 14, for containing fluid. Flows of fluid into or out of those chambers are individually controllable by valves 15, 16 and 17 in flowline 11. A pressure transducer 18 is provided for measuring the pressure of the fluid in flowline 11 and an equalizing valve 19 is arranged for opening the flowline into fluid communication with the fluid in the borehole of the well.

Figure 3:
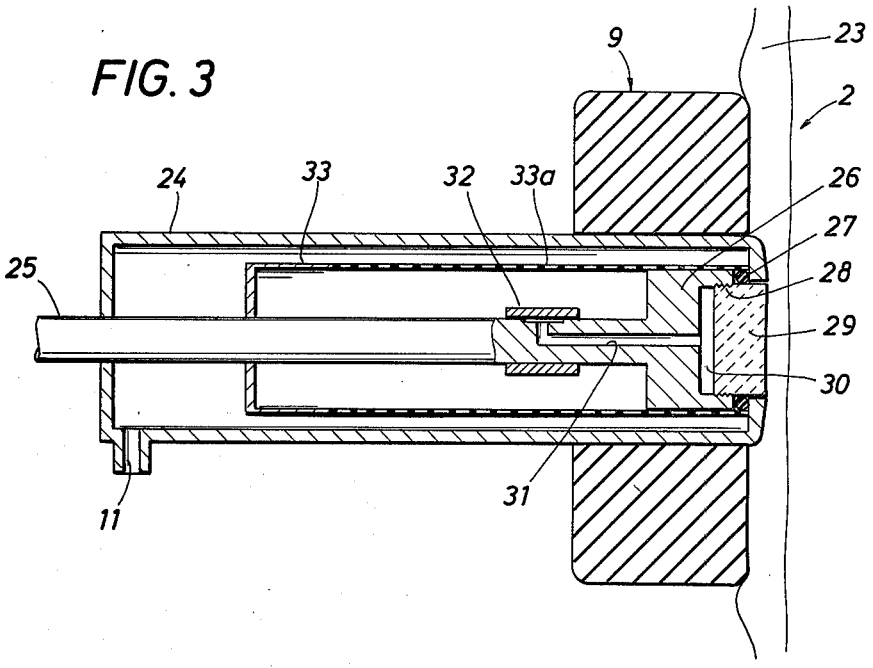
FIGS. 3 to 6 are schematic illustrations of modifications of an apparatus of the type shown in FIG. 2 in various stages of being arranged and used in accordance with the present invention.

FIG. 3 schematically illustrates how a portion of a tool of the type shown in FIG. 2 can be modified and utilized in practicing the present invention. FIG. 3 shows the packer element 9 pressed against a water-base mudcake 23 along a portion of a borehole wall adjacent to an oil column 2 of a reservoir of the type shown in FIG. 1. As shown, the flowline 11 is connected to a packer 9 via probe 24 within which there is a movable piston shaft 25 and piston 26. As shown, the piston 26 is advanced toward the right until its end is sealed against the outer end of probe 24 by O-ring 27. Piston 26 is connected by threads 28 to a selectively water-permeable diaphragm 29. The diaphragm 29 can be either or both a capillary diaphragm or an integral permeable material having pores which are too small to pass the particles of the water-base mudcake 23. The diaphragm 29 is mounted within the piston so that a passage 30 behind it connects with a channel 31, through the shaft 25. The channel 31 emerges from the shaft 25 through port 37 (FIG. 4) which is closable by the sleeve valve 32. The piston 26 is immediately surrounded by cylinder 33 which contains a screen, 33*a*, for preventing the entry into the tool interior of and grains or debris.

Figure 4:
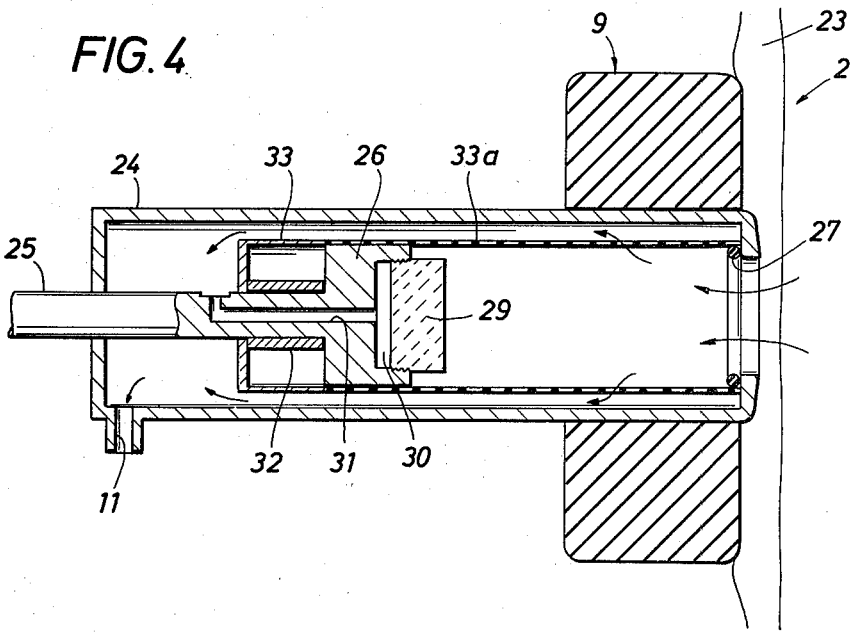
Figure 6:
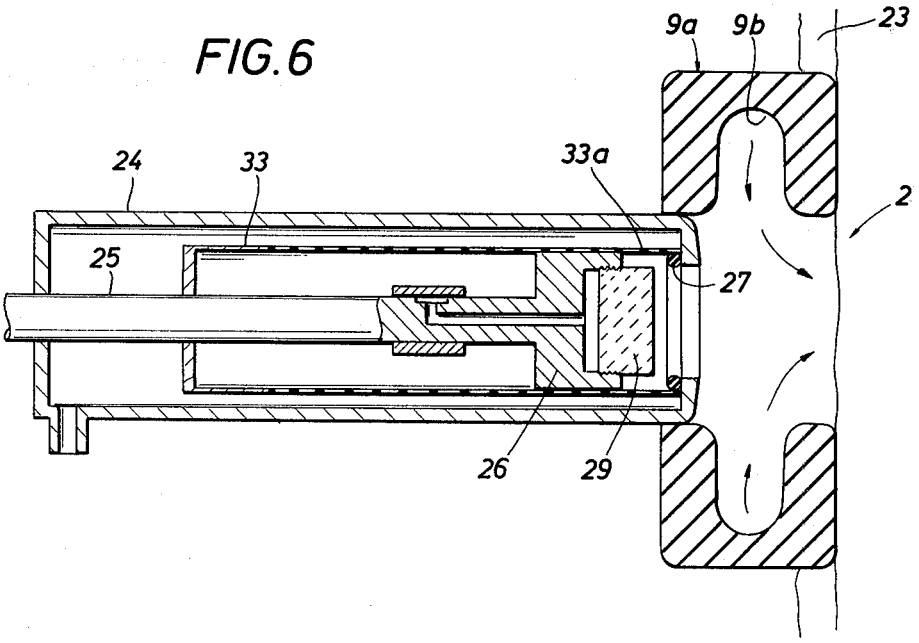

When the piston 26 is moved a slight distance to the left it exposes a portion of screen 33*a* as shown in FIG. 6 without opening the port 37 as shown in FIG. 4. When this is done, fluid is free to enter the probe 24, to flow through screen 33*a* and to flow along the annulus between cylinder 33 and probe 24 to the flow line 11, as shown by the arrows in FIG. 4. With the probe so arranged fluid from the reservoir can be drawn into one or more of the chambers 12, 13 and 14 for testing the efficiency of the sealing, collecting samples and/or making measurements of the reservoir fluid pressure, etc., by means of the conventional procedures for operating such a formation tester.

In order to measure the formation water pressure in accordance with the present invention, the tool is preferably first positioned with packer 9 pressed against the mudcake, as shown in FIG. 3; but with the piston 26 in the position of intermediate withdrawal to the left, as shown in FIG. 6. At this stage water suitable for imbibition into the reservoir should be present within at least one of the fluid containers 12, 13 or 14. An appropriate one of the valves 15 to 17 is opened and water is displaced from the container through the flowline 11 and around the piston 26 in order to flush the flowline and probe assembly with clean water. The valve leading to the water container is then closed and piston 26 is moved to the left until sleeve valve 32 is shifted to expose port 37 of passageway 31, as shown in FIG. 4.

Figure 5:
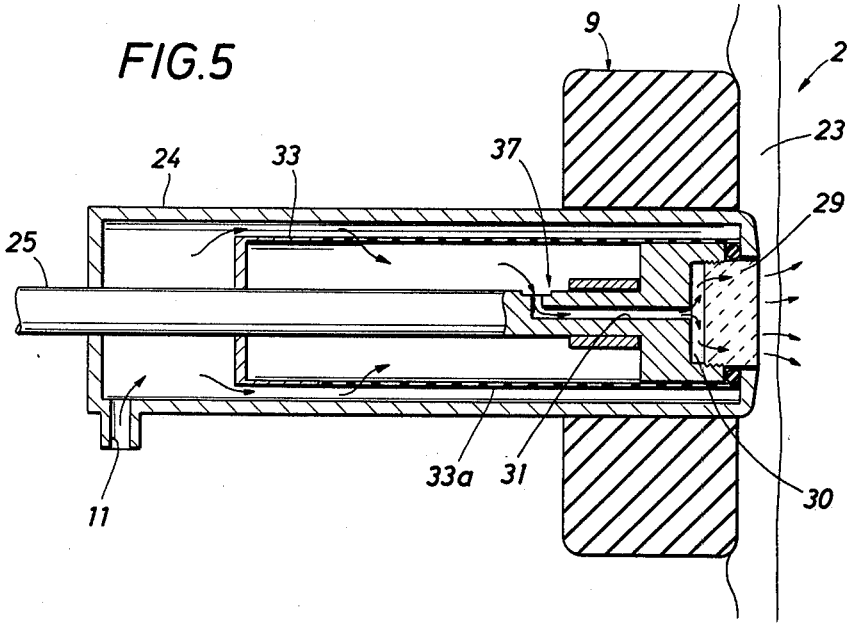

Probe 24, with port 37 exposed, is then positioned with the diaphragm 29 contacting mudcake 23, as shown in FIG. 5. Water is then displaced through the passageway 11 and, as shown by the arrows in FIG. 5, is displaced through screen 33*a*, port 37, conduit 31, diaphragm 29, and water-base mudcake 23 into the reservoir formation 2. The valve leading to the water chamber is then closed. This establishes a small volume continuous phase or column of water that extends through the selectively water-permeable diaphragm and mudcake and into the reservoir formation. The pressure within that column of water is subsequently measured, by means of the pressure transducer 18. (FIG. 2) Such a measurement can be made as soon as the decreasing water pressure, due to the imbibition of the water into the reservoir formation, becomes substantially asymptotic with respect to the value that would ultimately be obtained. This provides a substantially true measure of the formation water pressure in reservoir 2 at the depth of the measurement.

As will be apparent to those skilled in the art, numerous variations can be employed in the particular arrangement of such a tool and the means for operating it. What is essential is (a) that a relatively small volume continuous water column be extended through a selectively water-permeable diaphragm which is selectively sealed against a water-base mudcake that covers the reservoir and (b) measurements are made of the pressure that exists in the water column after the imbibition of water into the reservoir is substantially complete or in equilibrium.

Alternatively, when employed in measuring the pore water pressure in a cap rock or shale layer adjacent to a hydrocarbon reservoir what is essential is that (a) a relatively small volume continuous water column be extended into the cap rock or shale layer, and (b) measurements are made of the pressure that exists in the water column after the imbibing of water into the cap rock or shale is substantially complete or in equilibrium.

In addition, in various situations, tool elements such as filters for the fluid taken into the tool may be modified or eliminated, operational sequences may be varied, and the like.

Where a capillary diaphragm is used it should comprise a material having an oil entry pressure which is high enough to effectively keep oil from entering while maintaining a permeability to water. And, such a diaphragm should be positioned for selective fluid communication between it and the reservoir. Such a diaphragm can be, for example, a water-base clay packed tightly between two clay-retaining permeable metal or ceramic frits or screens having pores sized to allow the passage of water while preventing the passage of a significant portion of the solid particles of a water-base mudcake, and/or a portion of a water-base mudcake, and/or a portion of a low permeability cap rock or shale which contains a water-phase in communication with the water phase in the reservoir.

In a tool arranged, as shown in FIGS. 3–6, the outer end of the probe 24, the diaphragm 29, and the packer element 9 should all have a curvature substantially matching the curvature of the borehole wall.

Where the well has been drilled with a water-base mud having a significant fluid loss, it is important that sufficient fluid be produced from the reservoir to ensure that substantially all of the filtrate has been removed from the measuring zone; i.e., the portion of the reservoir immediately behind the portion of the borehole wall which is contacted by the logging tool. In general, the only significant proportion of aqueous liquid which should be present in that region at the time of the measurement of the formation water pressure should be the interstitial water which is naturally present in that portion of the reservoir. The proportion of aqueous drilling fluid filtrate preferably should amount to less than about 2% of the aqueous liquid in that region although this figure depends on the slope of the water-hydrocarbon capillary pressure saturation curve.

The filtrate from an aqueous drilling mud can be removed from the measuring zone within the reservoir by producing fluid from that portion of the reservoir. Such a fluid production can be effected prior to or after the reservoir portion from which the fluid is produced is isolated by a packer such as packer 9 that isolates a relatively small portion of the borehole wall from contact by the fluid in the borehole. In various situations, the water-base mudcake may be relatively thin or readily removed so that, particularly after such a fluid production, insufficient mudcake is present between the packer and the borehole wall to ensure the accuracy of a measurement of the formation water pressure. If there is substantially no mudcake on the borehole wall at the measuring location, a continuous body of oil may occupy the space between the capillary diaphragm and the reservoir formation and thus interrupt the continuity of the water column required for the measurement of the formation water pressure.

In a situation in which the water-base mudcake is apt to be absent, e.g., where the borehole is drilled with an oil-base fluid, or removed, e.g., where a significant amount of reservoir fluid is produced, a water-base mudcake can be emplaced (for the purpose of measurement) by a system and procedure of the type illustrated in FIG. 6. In this embodiment the measuring tool is equipped with a packer 9*a* which contains cavities or pockets 9*b* within which a portion of water-base mud can be stored. During the run-in of the tool, the so-stored mud is confined by having the probe 24 in a position such as that shown in FIG. 3, blocking the openings of the side pockets 9*b*. The packer 9*a* is then pressed against the wall of the borehole with the probe 24 retracted, as shown in FIG. 6. As the packer is compressed (by the pushing action of backshoe 10, pushing against the opposite side of the borehole wall) the mud is pushed out of the pockets 9*b* and into the central opening where it forms a water-base mudcake as the liquid it contains is displaced into the reservoir formation when water is injected through probe 24 and the probe, preferably with piston 26 sealed against O-ring 27, is moved to the right.

In general, the possible need for such a mudcake implacing treatment can be determined by the results of a measurement of the formation water pressure. The establishment of a good seal between the packer 9 and the borehole wall can be determined by procedures which are conventionally used with a repeat formation tester of the type shown in FIG. 2. If the packer-to-wall seal is good and the measured formation water pressure is substantially equal to the oil pressure at the depth of the measuring location, it is likely that the continuity of the water column was not maintained. As mentioned above, where the mudcake is small or nonexistent between the capillary diaphragm and the reservoir, sufficient oil is apt to accumulate between the two to destroy the continuity of the water column. And, a procedure such as the one described above should be employed to emplace a water-base mudcake, which can comprise substantially any pumpable, water-base mud or completion fluid containing sufficient wall-coating and bridging solid materials and filter-loss materials to provide a significant but limited amount of water entry into the formation.

In addition to the alternative shown by FIG. 6, inaccuracies due to an invasion of the filtrate from a water-based mud can be avoided by drilling into the reservoir at the depth selected for the measurement with an oil-base drilling or completing fluid and then circulating-in sufficient water-base mud to displace the mudcake from the oil-base fluid with a water-base mudcake. In addition, where desirable, the diaphragm 29 can be formed in layers so that the outermost layer comprises a deformable porous material having pores too small to pass significant proportions of the water-base mudcake particles (such as finely-pored deformable plastic screen) and an intermediate portion of the diaphragm comprises a selectively water-permeable capillary diaphragm such as a mass of water-wet, water-base clay which is held in place by a porous material having pores too small to pass a significant proportion of the clay particles. Such a layered diaphragm can be used where there is little or no water-base mudcake on the borehole wall in order to ensure that the substantially continuous water column extends through enough selectively water-permeable capillary diaphragm to prevent the inflow of oil into the logging tool. Alternatively, or additionally, the logging tool packer for selectively isolating a portion of the borehole wall (such as packer 9) can advantageously be corrugated with concentric rings encircling the portion through which the continuous column of water is to be established, so that the corrugations reduce the tendency for any water-base mudcake present on that portion of the borehole to be squeezed away from the packer-isolated portion of the wall while the packer is being pressed against the wall.

Another alternative for avoiding the inaccuracies due to the invasion of mud filtrate is to position the tool in a non-productive layer such as the cap rock or a shale layer immediately adjacent to the productive formation and measure the water pressure by the methods described above in that layer.

What is claimed is:

1. A process for directly measuring a pressure substantially equalling the formation water pressure in an oil-productive portion of a subterranean reservoir comprising:

displacing a limited volume of water into a continuous water-phase which (a) extends through a material which has an oil entry pressure which is high enough to effectively prevent oil entry while maintaining a permeability to water and thus to function as a selectively water-permeable capillary diaphragm and (b) extends into the oil-productive reservoir;

allowing the pressure within said water-phase to be reduced by the imbibition of water into the reservoir; and, subsequently measuring the pressure within said water-phase.

2. A well logging process for measuring the formation water pressure in an oil-productive layer within a dipping reservoir which contains a water layer at a location different from the measuring location, comprising:

mechanically displacing water within a logging tool at a selected depth within the well so that the displaced water forms a water column which has a relatively small volume, is continuous, extends through a permeable material having pores too small to pass a significant proportion of particles of a water-base mudcake, extends through material capable of functioning as a selectively water-permeable capillary diaphragm, and extends into said oil layer;

maintaining the water within said water column substantially static until the rate at which its pressure decreases due to the imbibition of water into the oil layer becomes relatively insignificant; and, measuring the pressure of water in said water column.

3. The process of claim 2 in which the logging tool is positioned at a depth at which the reservoir oil layer is coated with a water-base mudcake and is substantially free of water-base mud filtrate and said mudcake is utilized as part or all of said capillary diaphragm.

4. The process of claims 2 or 3 in which a portion of low fluid-loss water-base mud is mechanically displaced within the logging tool to form a water-base mudcake on the oil layer and the so-formed mudcake is utilized as part or all of said capillary diaphragm.

5. The process of claim 2 in which the well is drilled through the depth selected for the measurement with an oil-base drilling or completing fluid and the mudcake formed by that fluid is replaced with water-base mudcake, prior to the forming of said water column.

6. The process of claim 2 in which the logging tool is positioned in an immediately adjacent cap rock or shale layer and said water column extends through the cap rock or shale layer and then into the oil layer.

7. The process of claim 6 in which the cap rock or shale layer comprises most or all of the material capable of functioning as a selectively water-permeable capillary diaphragm.

* * * * *